US005649381A

United States Patent [19]

Studer

[11] Patent Number: 5,649,381

[45] Date of Patent: Jul. 22, 1997

[54] PERSONAL OBJECT CARRYING MEDICAL DETAILS

[75] Inventor: René Studer, Breitenbach, Switzerland

[73] Assignee: Presmatec S.A., Mervelier, Switzerland

[21] Appl. No.: 387,761

[22] PCT Filed: Jun. 23, 1994

[86] PCT No.: PCT/CH94/00126

§ 371 Date: Feb. 15, 1995

§ 102(e) Date: Feb. 15, 1995

[87] PCT Pub. No.: WO95/00939

PCT Pub. Date: Jan. 5, 1995

[30] Foreign Application Priority Data

Jun. 23, 1993 [CH] Switzerland ..... 1883/93

[51] Int. Cl.[6] ..... A44C 5/00

[52] U.S. Cl. ..... 40/633; 368/281

[58] Field of Search ..... 368/281, 282, 368/10, 28, 41; 40/633, 495

[56] References Cited

U.S. PATENT DOCUMENTS

| | | | |
|---|---|---|---|
| 872,700 | 12/1907 | Van Halder | 40/495 |
| 1,024,195 | 4/1912 | Göthberg | 40/495 X |
| 1,160,616 | 11/1915 | Jeffery | 368/282 X |
| 2,749,634 | 6/1956 | Billett et al. | 40/633 |
| 3,852,953 | 12/1974 | Mischiatti | 368/28 |
| 4,234,943 | 11/1980 | Teramoto et al. | 368/28 X |
| 4,470,708 | 9/1984 | Nee | 368/281 X |
| 4,733,383 | 3/1988 | Waterbury | 368/10 |
| 4,976,548 | 12/1990 | Tschanz | 368/282 X |
| 5,168,480 | 12/1992 | Dodier | 368/282 |
| 5,187,693 | 2/1993 | Besson | 368/28 X |
| 5,479,381 | 12/1995 | Goldenberg et al. | 368/282 |

FOREIGN PATENT DOCUMENTS

| | | |
|---|---|---|
| 1272870 | 8/1961 | France . |
| 1513675 | 2/1968 | France . |
| 2 372 479 | 6/1978 | France . |
| 1 288 417 | 1/1969 | Germany . |
| 26 19 419 | 11/1977 | Germany . |
| 28 09 890 | 9/1979 | Germany . |
| 161892 | 8/1933 | Switzerland . |
| 655221 | 4/1986 | Switzerland . |
| 668158 | 12/1988 | Switzerland . |
| 2 247 963 | 3/1992 | United Kingdom . |

*Primary Examiner*—Joanne Silbermann
*Attorney, Agent, or Firm*—Davis and Bujold

[57] ABSTRACT

A personal object, particularly a watch, medal or bracelet, to be worn by an individual and bearing personal medical information about the individual. The object is designed so that the individual's confidential medical information is not visible from the exterior when the individual wears the object but can be readily found and understood by the staff of rescue agencies aiding the individual. The medical information is set out in standardized form on different sections of an indication surface (6) which is covered by an ID tag (5) that bears, in particular, information on the individual's identity. Each section of the indication surface (6) is covered by a removable tag portion (73) on the ID tag (5). If the individual has a medical risk indicated on one of the sections, the individual simply breaks the tag portion (73) covering that section to reveal the medical risk shown on that section through the ID tag. The existence of this risk is shown by means of a display device on the front face of the object, for example on the watch face in the case of a watch, and complementary data concerning the risk can be shown by the display device and by tabs (7–10) attached to the watch bracelet (3).

14 Claims, 5 Drawing Sheets

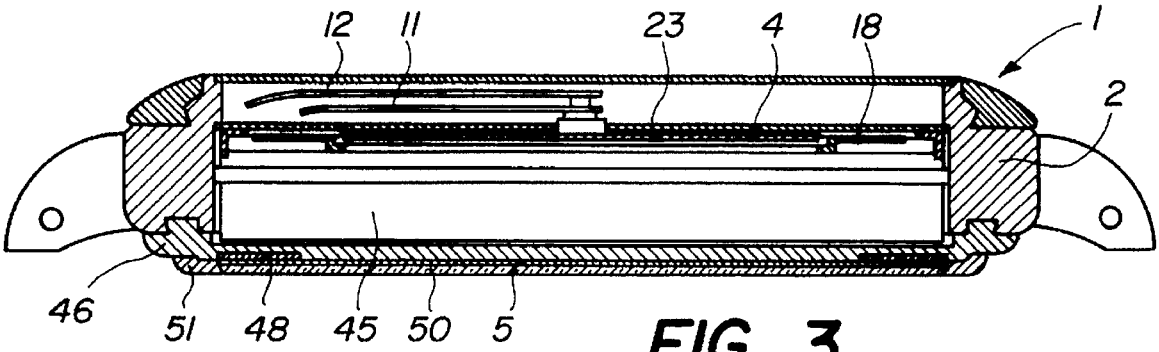
FIG. 3
FIG. 4
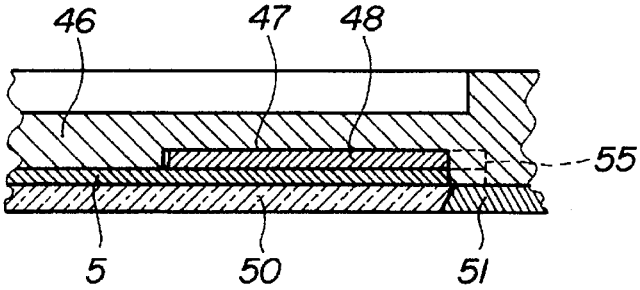
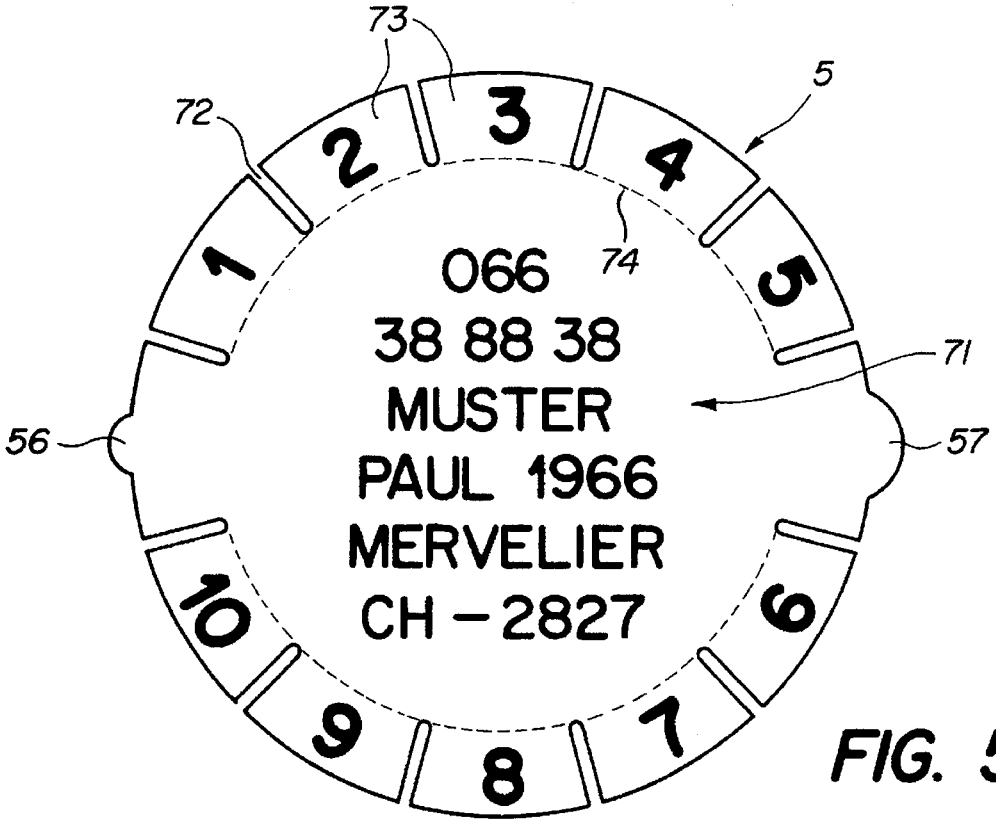
FIG. 5

PERSONAL OBJECT CARRYING MEDICAL DETAILS

The present invention concerns a personal object for an individual to wear, specifically a watch, a medal or a bracelet, including indicating means showing medical information about that person.

In many accident cases it is found that the injured person often does not carry current emergency medical information, or that emergency personnel cannot locate the information. This situation is caused by that fact that emergency instructions which people carry are often not readily accessible. As a result, an injured person risks receiving inappropriate or even dangerous medical treatment.

There have been various proposals for supplying personal medical information on a personal object to be worn at all times, such as a wristwatch, a piece of jewelry, a medal, etc., perhaps in combination with a symbol to attract attention and/or an inscription showing the individual's identity. Such objects are described in publications FR-A-1 272 870, FR-A-1 513 675, FR-A-2 372 479 and DE-A-2 619 419. However, all these objects have disadvantages and shortcomings which have discouraged widespread use. In order for such an information system to be reliable and effective, it must be widely used and well known to emergency workers responding to accidents. To become well known, the objects in question must be worn by many people; that is, they must meet criteria such as convenience, effectiveness, appearance and cost. The objects must be clearly recognizable as indicators of personal medical information, but since the information is confidential, it should not be visible when the object is worn.

Certain of these conditions are fulfilled, for example, by the jewelry described in document FR-A-2 372 479. Medical information such as blood type, allergies, infections requiring precautions, as well as the wearer's identity, are inscribed on a hidden surface, while a generally visible surface of the jewelry has a symbol for attracting attention, such as a red cross or the SOS sign. For example, the hidden surface may be concealed by a pivoting cover with the exterior symbol. The hidden surface may simply be the inside surface of a bracelet, with the symbol on the outer surface. However, this type of jewelry is not in common use, except for blood type identification. Apart from esthetics, there are also various technical reasons for this. Engraving the user's identity and medical information requires space and is also costly. In addition, if the wearer's health condition changes, it is difficult to change the information. Finally, there is presently no standardized medical information system and even if it were to exist, such an object could not readily adapt to it.

Several of the documents cited above provide for engraving medical information and a person's identity on a wristwatch, for example, on the base or on plates affixed to either the watch or the bracelet. Document FR-A-1 272 870 proposes a medal or a watch with a covered housing which holds a document providing useful emergency information. It also has a distinctive visible symbol indicating that the object contains this information. But such an object also has the disadvantages mentioned above.

The present invention proposes an object such as that defined in the preamble, which can be worn at all times and which is designed so that emergency personnel can clearly, readily identify necessary information, while the information remains confidential. It is also desirable to be able to modify the information easily and without incurring additional cost. A specific aim of the invention is to provide a compact watch of current design, particularly a wristwatch, to furnish such information.

According to a basic principle of the present invention, the subject is a personal object of the type described above, characterized in that the information indicators consist of an indication surface having a series of fields with graphics representing respective medical conditions, and an individual identification plate which at least partially covers the indication surface and furnishes the identity of the wearer, said identification plate having removable segments above these fields, each segment covering one of the fields in the initial phase when the segment is attached to the plate, and revealing the field when the segment is removed from the plate.

With such an arrangement it is possible to provide a series of standard medical data covering the most current risks on the respective fields of the indication surface; that is, this surface can be the same for all individuals and is preferably universal. The wearer's individual conditions are then indicated by removing appropriate segments from the plate to reveal the corresponding fields, and these risks are then associated with the identity of the individual concerned, inscribed on the plate along with other information such as, for example, birth date, address, etc. Such a plate is inexpensive and easily changed if one of the conditions disappears. If a new condition arises, it is necessary only to remove the corresponding segment. Even in the absence of an international system for identifying medical information, the position of each visible field is sufficient to identify the corresponding condition. Thus, medical information can be discreetly supplied on certain types of personal objects where the indication plate cannot be permanently hidden, such as pendants. Furthermore, the indications are not language specific.

The indication surface and the identification plate are preferably located on an interior surface or on the underside of an object which is invisible when worn, and the visual warning symbols are located on an upper surface of the object which is visible when worn. The warning symbols preferably consist of conventional symbols representing health service or first aid, in a fixed, permanently visible position. Thus, emergency personnel would notice immediately that the object can furnish useful medical information in an emergency.

In a preferred embodiment, the visual symbols consist of a display device with control means and at least one window to selectively display at least one symbol of a medical condition. The display device provides a readily visible sign on the visible surface of the object alerting emergency personnel to look for the personal medical information provided on a concealed surface of the object.

In a preferred embodiment the display means is a mechanical device, that is, one which will function at all times and is not dependent upon the battery supplying an electronic watch movement, for example.

The display device may include a watch face, a first rotatable disk located behind the face and which is associated with control means, a first and a second window in the face, and at least two different warning symbols on the first disk which appear selectively in the windows. The first disk preferably has four stable positions, and the two warning symbols on the first disk are arranged so they appear in said windows corresponding to said stable positions.

The display means may also comprise another window for displaying a person's blood type. Specifically, the display means may comprise a second rotatable disk located behind the watch face, associated with control means, and with a circular arrangement of symbols representing various human blood types corresponding to said other window.

In an advantageous embodiment, the disk or each disk is integral with a star-shaped element, the spokes of which cooperate with a jump spring to define the stable disk positions, and with the control means which includes a button acting on the spokes of the star.

The indication surface and the identification plate may be located in a groove on a lower surface of the object, and the plate and the groove have complementary shapes around their edges which define a unique position for the plate to engage in the groove.

The indication surface is preferably located on a ring placed in the base of the groove, near its periphery, and the removable segments are pre-cut portions located around the rim of the identification plate. They are designed to be broken off individually.

If the personal object is in the form of a wristwatch, the visual warning symbols are advantageously combined with the watch face. The window or each window may be located in the watch face. The display device may be inside a watch case, between the face and the watch movement. If it is a wristwatch, at least one complementary plate showing medical information may be attached to an inside surface of the bracelet.

In every embodiment of the personal object according to the invention, the object may have a cover, hiding the identification plate, which can be opened manually. This ensures that the confidential medical information on the plate is not outwardly visible if the object turns over accidently, as in the case of a medal, for example.

Other characteristics and advantages of the invention will be apparent from the following description of various embodiments, with reference to the attached drawing, in which:

FIG. 3 is a schematic cross-section of the watch taken along line III—III of FIG 1;

FIG. 4 is an enlargement of a detail of FIG. 3;

FIG. 5 shows the initial state of an identification plate disposed on the lower watch surface;

Figure 1:
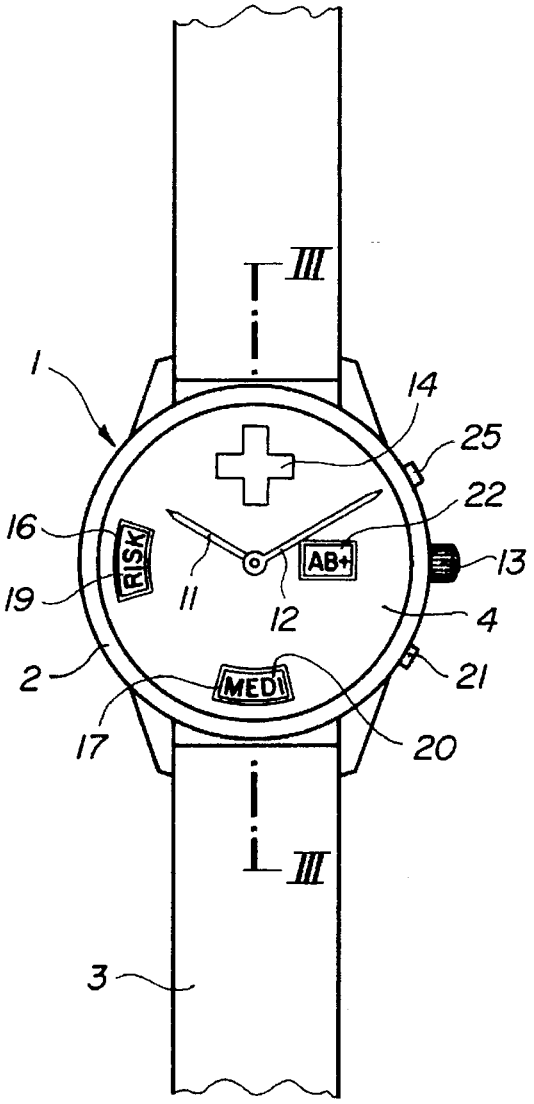
FIG. 1 is a view of the upper surface of a wristwatch according to the invention.
Figure 2:
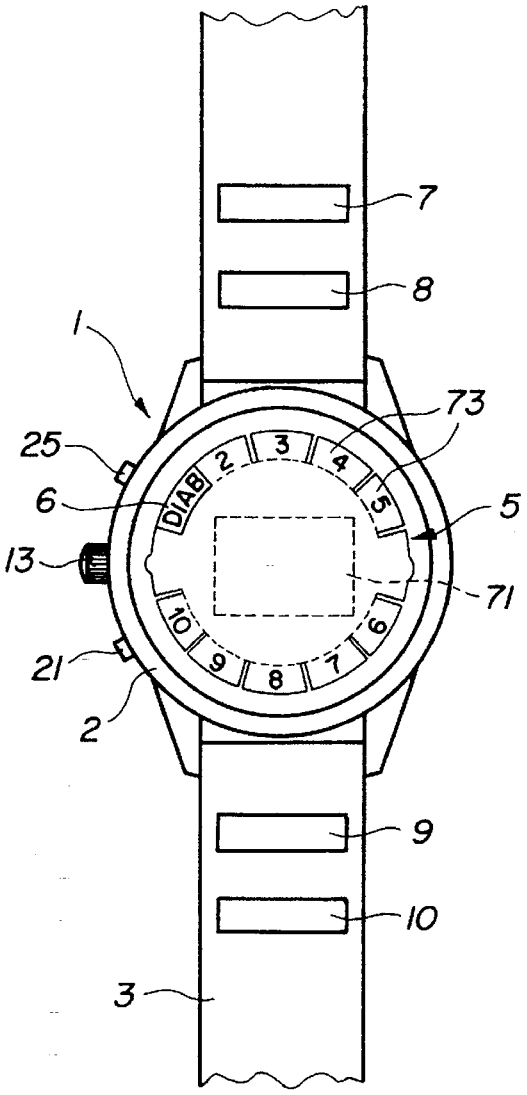
FIG. 2 is a view of the lower surface of the watch of FIG. 1.
Figure 6:
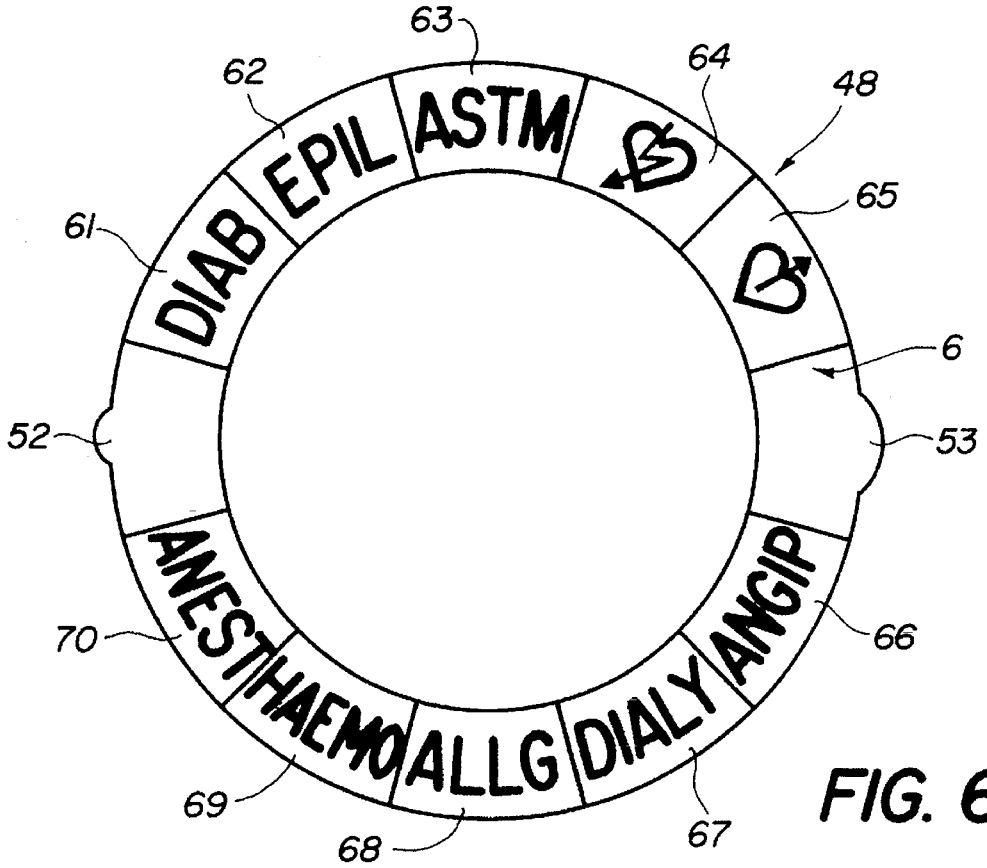
FIG. 6 shows a ring, located beneath the identification plate, which has an indication surface.

In a preferred embodiment shown in FIGS. 1 through 10, the personal object is a wristwatch 1 comprising a conventional watch case 2 with a bracelet 3. Case 2 may be that of a conventional calendar watch designed to display dates and days of the week in the windows of watch face 4, but in this instance, the mechanism has been modified to display other messages, as will be described. As shown in FIG. 2, on the back of wristwatch 1, the wearers personal medical information is shown by an identification plate 5 which at least partially covers an indication surface 6, and possibly by complementary plates 7 through 10 attached to the back of bracelet 3. Thus, when the wristwatch is worn by the owner, the medical information is hidden from view.

Conventional watch hands 11 and 12 display the time on the watch face 4. However, any kind of time display is possible, in particular liquid crystal display. There is also a time setting crown 13 with the same function as in a conventional watch. Watch face 4 bears a standard symbol such as a red cross or other well known symbol representing medical care or first aid. The purpose of this symbol is to alert emergency medical personnel to the fact that this is a specialized watch furnishing medical information. The display means replacing the calendar comprises a first window 16 and a second window 17 in face 4, a first rotatable disk 18 (FIG. 7) located behind these windows and having warning symbols 19 and 20 which appear selectively in windows 16 and 17 once disk 18 has been turned to the appropriate position using the stepping control mechanism activated by button 21. In the present example, the display means further comprises a third window 22 behind which there is a second rotatable disk 23 (FIG. 8) with a complete series of conventional symbols 24 regarding blood type and RH factor to furnish the wearer's blood type. For this purpose the second disk 23 also has a stepping control mechanism activated by button 25. Both buttons 21 and 25 may be conventionally designed buttons for setting the date and day of the week, but in this case they are preferably recessed within the wall of case 2 to avoid accidental activation. They are activated with any type of pointed instrument. The disk control mechanism, which will be described later with reference to FIGS. 9 and 10, ensures that the position selected for each disk is permanent and stable; therefore, the user need use button 21 only if his or her health condition changes.

Figure 7:
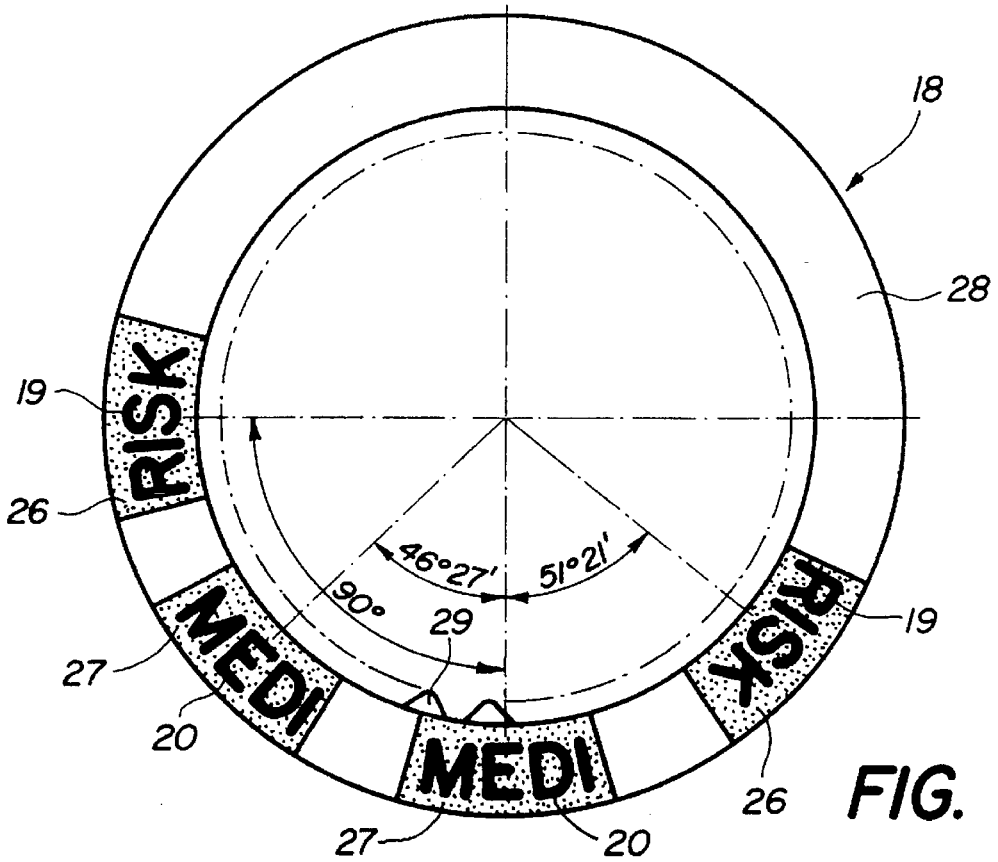
FIG. 7 is a front view of a first rotatable disk forming part of a display device cooperating with the watch face.

As shown in FIG. 7, first disk 18 displays the warning 19 RISK twice, to indicate that a medical risk is shown on the back of the watch, and the warning 20 MEDI twice, to indicate that the wearer must take medication regularly. Each warning 19, 20 is in a respective colored zone 26, 27 (for example, red to attract attention) on an annular rim on base 28, which is neutral in color, for example, the same color as watch face 4. Two warnings 19, 20, respectively located to the left and at the bottom in FIG. 7, are 90° apart, corresponding to the angle separating windows 16 and 17, so that both warnings appear at the same time in these windows. The two other warnings 19 and 20 are separated from the preceding warnings by a different angle (45°), and by an angle from each other, so they may appear separately in corresponding window 16, 17 when the other window is empty. This device ensures that windows 16, 17 can display either one of warnings 19, 20, or both, or neither, depending upon the wearer's health.

Figure 9:
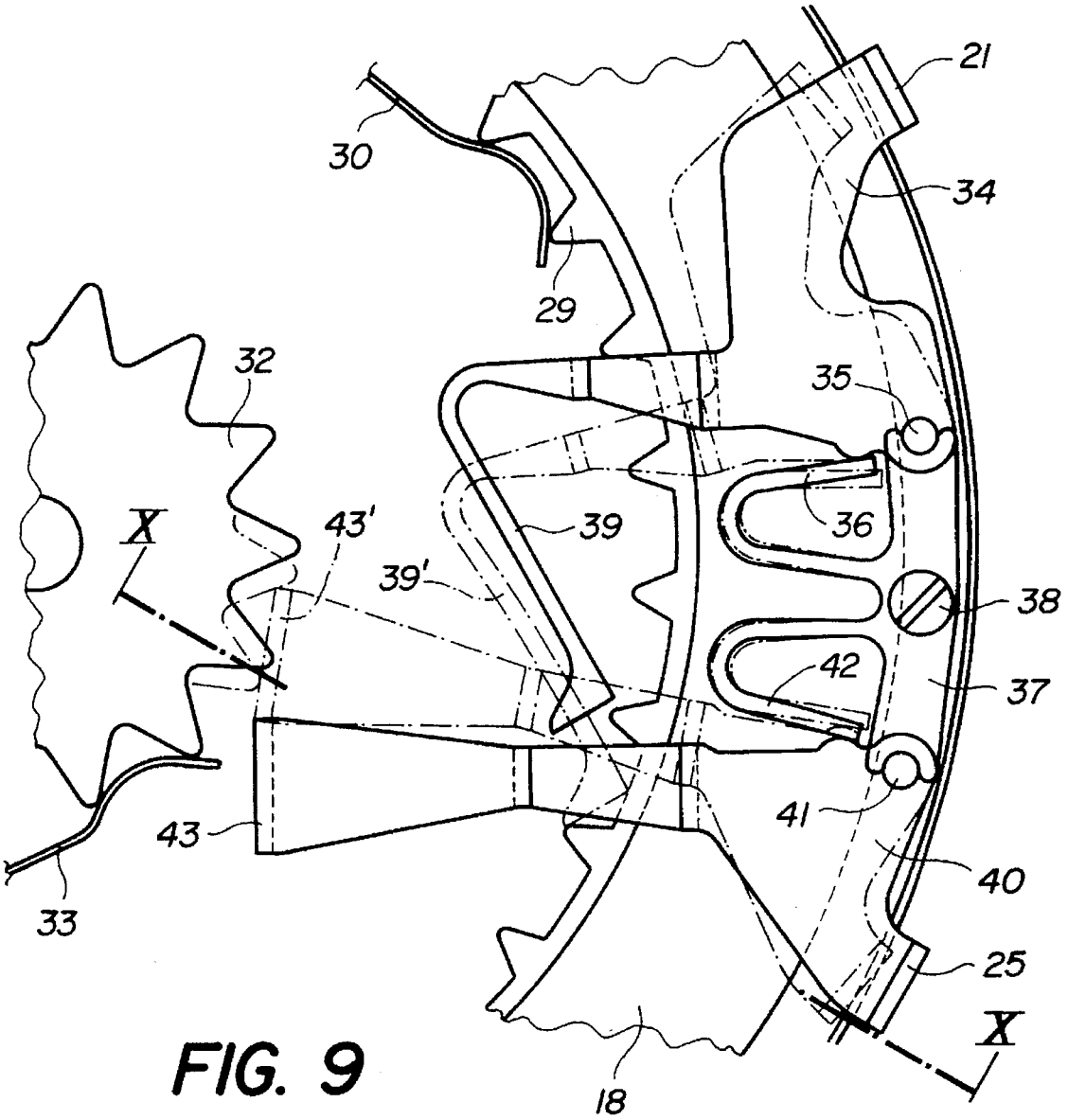
FIG. 9 is a schematic view of the device for controlling the display device.
Figure 10:
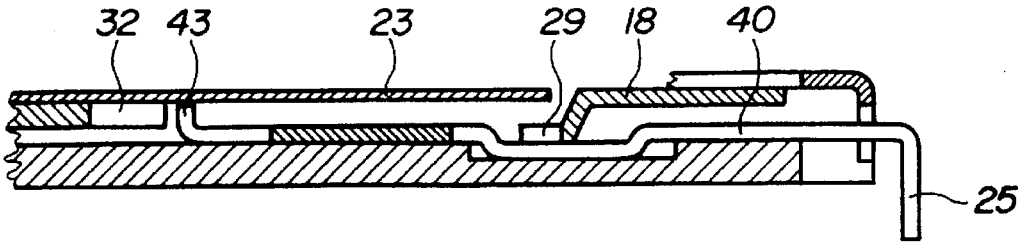
FIG. 10 is a partial cross-section taken along line X—X of FIG. 9.
Figure 8:
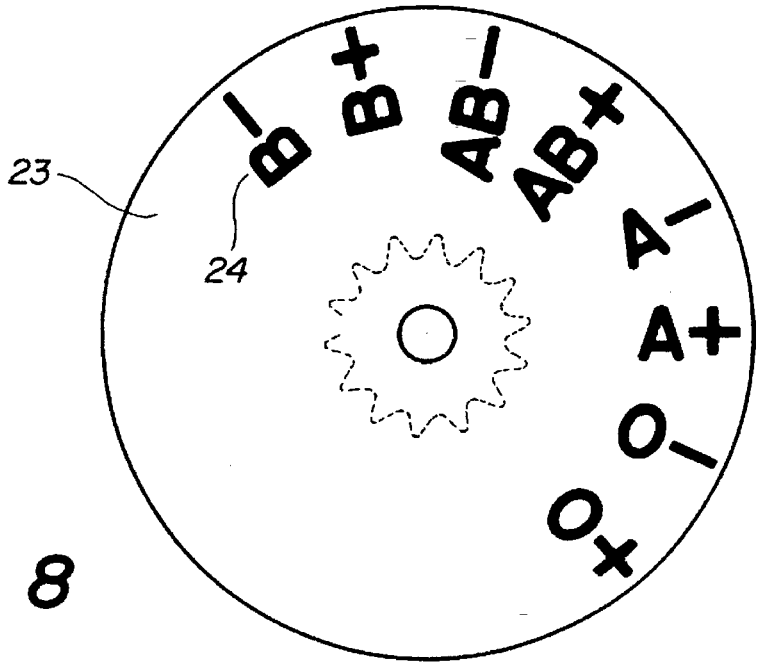
FIG. 8 is a front view of a second rotatable disk forming part of the display device.

FIGS. 9 and 10 schematically represent the mechanism for controlling disks 18 and 23. This mechanism is actually that of a calendar watch in which the means for controlling display through the watch movement has been eliminated. First disk 18, corresponding to the daily disk in a calendar watch, is annular in shape and has along its interior rim a star 29 with 31 spokes cooperating with a jump spring 30 defining and maintaining each disk position. The second disk 23, corresponding to the date disk of a calendar watch, is integral with a star 32 with fourteen spokes, cooperating with a jump spring 33 defining and maintaining each disk position. Button 21 forms part of a pivoting piece 34 maintained in contact with a pivot 35 by an arm 36 of a spring element 37 attached with a pin 38. Piece 34 has a pushing arm 39 which engages one of the spokes of star 29 when button 21 is pushed and, by advancing to position 39' shown by dashed lines, rotates disk 18 by one unit. Similarly, to rotate star 32, integral with disk 23, by one unit, there is a pivoting piece 40 held in contact with pivot 41 by a second arm 42 of spring 37. Piece 40 has an angled extremity 43 which pushes spokes 32 into position 43' shown by dashed lines.

FIG. 3 shows that case 2 of watch 1 contains, beneath the display device with disks 18 and 23, a conventional watch movement 45 for driving hands 11 and 12. As is usually the case, the bottom of the case is closed by base 46 which, in the present case, has the particular shape shown in FIGS. 2 and 4. A groove 47 is formed on the lower surface of base 46 to receive circular ring 48 and identification plate 5. These two elements are covered by a crystal 50 held by a rim 51 attached to base 46. Ring 48, shown in detail in FIG. 6, supports the indication surface and has two opposing protruding elements 52 and 53 which differ in shape and size, and engage in two respective lateral indentations such as 55 (FIG. 4) in base 46 so that ring 48 remains in one position. Indication surface 6 has ten equal angular fields 61 through 70 where the medical indications listed in Table I appear in symbolic or code form, preferably a universal form.

TABLE I

| Field | Symbol | Medical Condition |
|---|---|---|
| 61 | DIAB | Diabetes |
| 62 | EPIL | Epilepsy |
| 63 | ASTM | Asthma |
| 64 | (drawing) | Pacemaker |
| 65 | (drawing) | Arterial Hypertension |
| 66 | ANGIP | Angina |
| 67 | DIALY | Renal Dialysis |
| 68 | ALLG | Various Allergies |
| 69 | HAEMO | Hemophilia |
| 70 | ANEST | Allergy to Anesthesia |

With reference to FIG. 5, identification plate 5 is a circular plate with the same exterior diameter as ring 48. Plate 5 also has two different protruding lateral elements 56 and 57, identical to protruding elements 52 and 53, which engage in the same openings in order to position the plate. Any useful information 71 about the wearer can be engraved or printed on plate 5, specifically, his first and last name, address, telephone number. On the perimeter of the plate, notches 72 define ten identical segments 73 identified by the numbers 1 through 10, respectively, and which cover fields 61 through 70, respectively, on indication surface 6. Each segment 73 is attached to the rest of the plate by a scored line 74 which can be folded and broken to detach the segment and reveal the corresponding field. In FIG. 2, for example, segment No. 1 has been removed to reveal the message DIAB in field 61 (FIG. 6), showing that the wearer is diabetic.

Complementary plates 7 through 10 shown in FIG. 2 may provide more precise information about the warnings shown on indicator surface 6; for example, by showing the types of allergies concerned. However, these plates generally are used to show other useful medical information such as vaccinations, preference regarding organ donation, whether the person is deaf, blind, mute or pregnant. Other useful information includes any type of medication the wearer uses permanently or regularly, shown by the warning MEDI on the front of the watch.

Identification plate 5 is a very simple, inexpensive part which offers a standardized display of the principal risks which are important when first aid is required, and which is immediately recognizable in most languages. The plate is easily personalized by inscribing the wearer's identity and when necessary, by breaking off one or more of segments 1 through 10, preferably after the user's doctor has completed a questionnaire.

Figure 11:
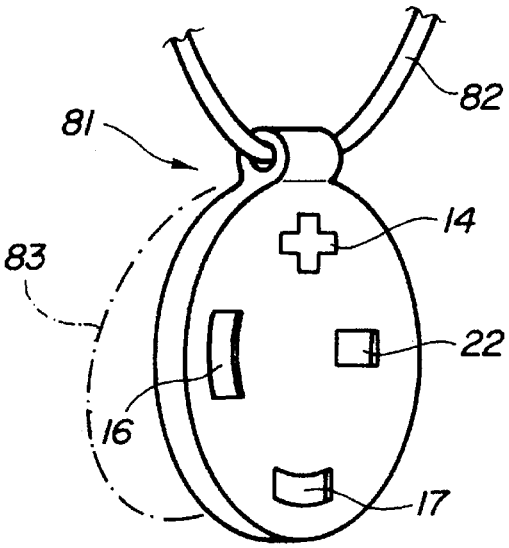
FIG. 11 is a schematic perspective of a medal according to the invention.

FIG. 11 schematically shows how a personal object according to the invention may be made in the form of a medal 81 hanging on a neck chain 82, with the same information on the front as the watch described above, except there is no time display: the red cross or other similar symbol 14, and with windows 16, 17 and 22 of the mechanical display device being housed inside the medal. The back surface of the medal may be identical to that of the watch, according to FIG. 2. Instead of having a crystal, the medal may be concealed by a pivotable cover 83 similar to that of a pocket watch.

Figure 12:
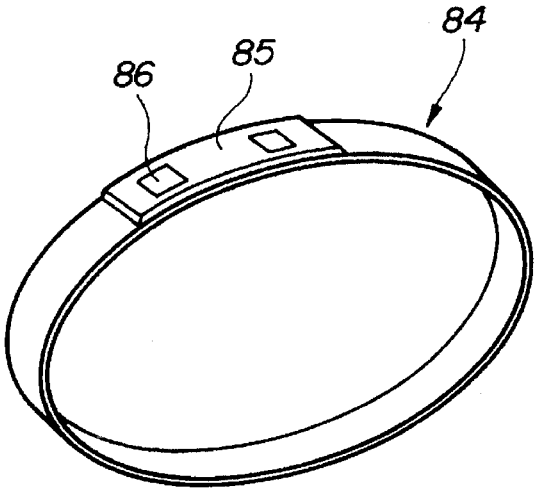
FIG. 12 is a schematic perspective of a bracelet according to the invention.

FIG. 12 shows another embodiment of the invention in the form of a bracelet 84, the outer surface of which has a plate with one or more warning symbols 86, such as a red cross or the message RISK, to indicate that medical information is provided on the concealed surface of the bracelet. This information is furnished in the same manner as with the wristwatch described above.

I claim:

1. A personal object that is to be worn by an individual and that is to provide personal medical information about the individual, comprising:

an indication surface (6) having a plurality of fields (61–70) bearing graphical representations of different medical information;

an individual identification plate (5) which at least partially covers the indication surface (6) and on which can be provided information identifying the individual; the identification plate (5) being provided with a plurality of removable segments (73) above the fields (61–70); each removable segment (73) covering one field (61–70) when the segment is attached to the identification plate (5) and revealing one field when the removable segment is removed from the identification plate;

a location of each removable segment being fixed relative to the field that the removable segment covers; and each removable segment being independently removable in order for the identification plate to reveal, one of no fields, one field and more than one field, depending upon the personal medical information to be shown by the wearer of the object.

2. A personal object according to claim 1, wherein the personal object is one of a watch, a medal and a bracelet.

3. A personal object according to claim 2, wherein the indication surface (6) and the identification plate (5) are located together in a groove (47) in a lower surface of the object, while the identification plate and the groove have complimentary shapes (54–57) around their respective perimeters which define a unique position in which the identification plate engages with the groove.

4. A personal object according to claim 3, wherein the indication surface (6) is located on a ring (48) placed in a base of the groove (47) near a periphery of the groove, and the removable segments (73) are pre-cut portions arranged around an edge of the identification plate (5) and are individually removable.

5. A personal object according to claim 2, wherein the indication surface (6) and the identification plate (5) are together located on one of an interior and a lower surface of the object, said surface is hidden from the individual when the object is worn by the individual, and at least one visual warning sign (14, 16–24) is located on an upper surface of the object, said upper surface is visible to the individual when the object is worn.

6. A personal object according to claim 5 in the form of a watch (1), wherein the at least one visual warning sign (14–24) is combined with a face (4) of the watch.

7. A personal object according to claim 6, wherein the at least one window (16, 17, 22) is located in the face (4) of the watch.

8. A personal object according to claim 5, wherein the at least one visual warning sign comprises a display device having control means (21, 25) and at least one window (16, 17, 22) for selectively displaying therein at least one warning symbol (19, 20, 24) concerning the personal medical information.

9. A personal object according to claim 8, wherein the at least one window displays a blood type of a wearer.

10. A personal object according to claim 8, wherein the display device (16–24) is located inside a case (2) of the watch, between the face and a movement of the watch.

11. A personal object according to claim 8, wherein the display device comprises a watch face (4), a first rotatable disk (18) located behind the face and associated with the control means, the at least one window consists of a first and a second window (16, 17) in the face, and at least two different warning symbols (19, 20) located on the first disk which can selectively appear in the first and second windows (16, 17).

12. A personal object according to claim 11, wherein the first disk (18) has at least four stable positions and the arrangement of the two warning symbols (19, 20) on the first disk is such that the warning symbols appear in said first and second windows in the following manner for said four stable positions:

in a first position, neither of the two symbols;

in a second position, both symbols;

in a third position, one of the symbols; and in a fourth position, the other symbol.

13. A personal object according to claim 11, wherein the display device comprises a second rotatable disk (23) located behind the face, which is associated with the control means and which has a circular arrangement of symbols (24) representing different human blood types, corresponding to one of the at least one window.

14. A personal object according to claim 11, wherein the disk or each disk (18, 23) is integral with a star (29, 32), spokes of the star cooperate with a jump spring (30, 33) to define stable disk positions, and the control means comprises a button mechanism (21, 25) which acts upon the spokes.

* * * * *